US005421106A

United States Patent [19]

Emrick

[11] Patent Number: 5,421,106

[45] Date of Patent: Jun. 6, 1995

[54] SHOE SOLE WIPING PAD

[76] Inventor: Steven C. Emrick, 7420 Stuhldreher St NW, Massillon, Ohio 44646

[21] Appl. No.: 196,543

[22] Filed: Feb. 15, 1994

[51] Int. Cl.[6] ..... A43B 23/00; A43B 23/26

[52] U.S. Cl. ..... 36/136; 36/54

[58] Field of Search ..... 36/132, 136, 99, 114, 36/54

[56] References Cited

U.S. PATENT DOCUMENTS

| | | | |
|---|---|---|---|
| 4,372,060 | 2/1983 | Adamik | 36/136 X |
| 4,377,913 | 3/1983 | Stone | 36/99 |
| 4,507,882 | 4/1985 | Harrell | 36/136 |
| 4,630,383 | 12/1986 | Gamm | 36/136 |
| 4,766,682 | 8/1988 | Malloy | 36/136 X |
| 4,805,321 | 2/1989 | Tonkel | 36/136 X |
| 4,823,426 | 4/1989 | Bragga | 36/136 X |
| 5,265,353 | 11/1993 | Marega et al. | 36/132 X |

FOREIGN PATENT DOCUMENTS

| | | | |
|---|---|---|---|
| 3337319 | 5/1984 | Germany | 36/136 |

*Primary Examiner*—Bryon P. Gehman
*Assistant Examiner*—BethAnne C. Cicconi
*Attorney, Agent, or Firm*—Paul E Milliken; Lee A Germain

[57] ABSTRACT

A removeable shoestring cover for athletic shoes which provides an upwardly facing wiping surface of suede or other suitable material and which cover is attached to the shoestrings at the upper and lower edge of the cover by flaps which fold around portions of the shoestrings and which flaps are held in the retaining position by a hook and loop type fastener or other suitable fastener.

10 Claims, 4 Drawing Sheets

SHOE SOLE WIPING PAD

FIELD OF THE INVENTION

This invention relates to a shoestring cover and more specifically to a shoestring cover for athletic shoes and the like, which cover can function as a wiping pad for the shoe bottoms or as a decorative cover.

BACKGROUND OF THE INVENTION

A problem has been encountered on floors such as on basketball courts where there is a constant accumulation of dust particles which attach to the bottoms of shoes of basketball players resulting in loss of traction when running during a game. Such dust accumulates rather quickly in spite of all attempts to keep the floor dust free. The players find it necessary to wipe the bottoms of their shoes with their hands to remove the dust from the bottoms of their shoes.

The present invention enables the players to more easily remove the dust from their shoe soles by wiping the shoe soles on an upwardly facing surface of a shoestring cover mounted on the instep of each shoe.

OBJECTS OF THE INVENTION

It is an object of this invention to provide a shoestring cover for athletic shoes, which cover has an upwardly facing wiping surface for cleaning the soles of the shoes of the wearer.

Another object of the invention is to provide a simple shoestring cover which is easy to attach to and remove from the shoe.

A still further object of the invention is to provide a shoestring cover having a decorative indicia thereon.

These and other object of the invention will become more fully apparent in the following specification and the accompanying drawings.

SUMMARY OF THE INVENTION

This invention is a shoestring cover for mounting on the instep portion of shoes having shoestrings, in a position to cover the shoestrings and provide an upwardly facing surface, the cover comprising: a substantially polygon shaped pad of sheet material having an upper edge, a lower edge, at least two side edges, a bottom side, and a top side having an upwardly facing surface thereon, a first attachment means at the upper edge of the pad for removably engaging a portion of shoe strings adjacent said upper edge of the pad, and a second attachment means at the lower edge of the pad for engaging a portion of the shoe or strings adjacent said lower edge of the pad.

DESCRIPTION OF THE PREFERRED EMBODIMENTS

Figure 1:
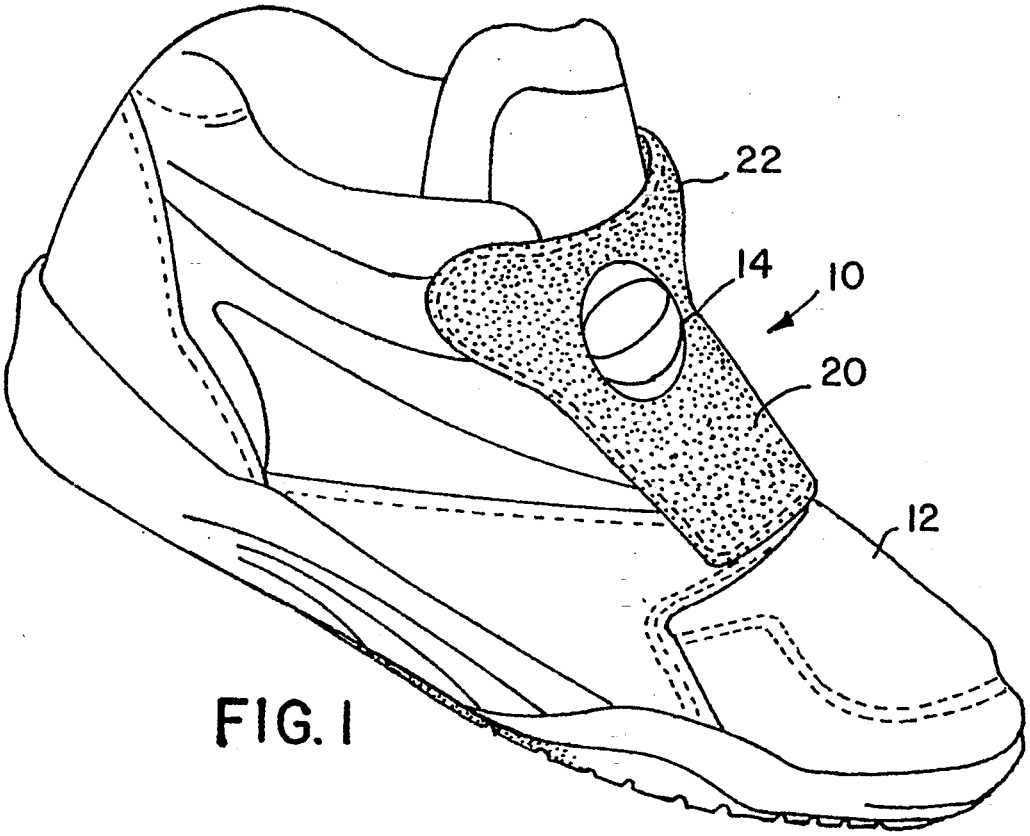
FIG. 1 is a perspective view of an athletic shoe having the shoestring cover of the invention mounted in operative position thereon.
Figure 2:
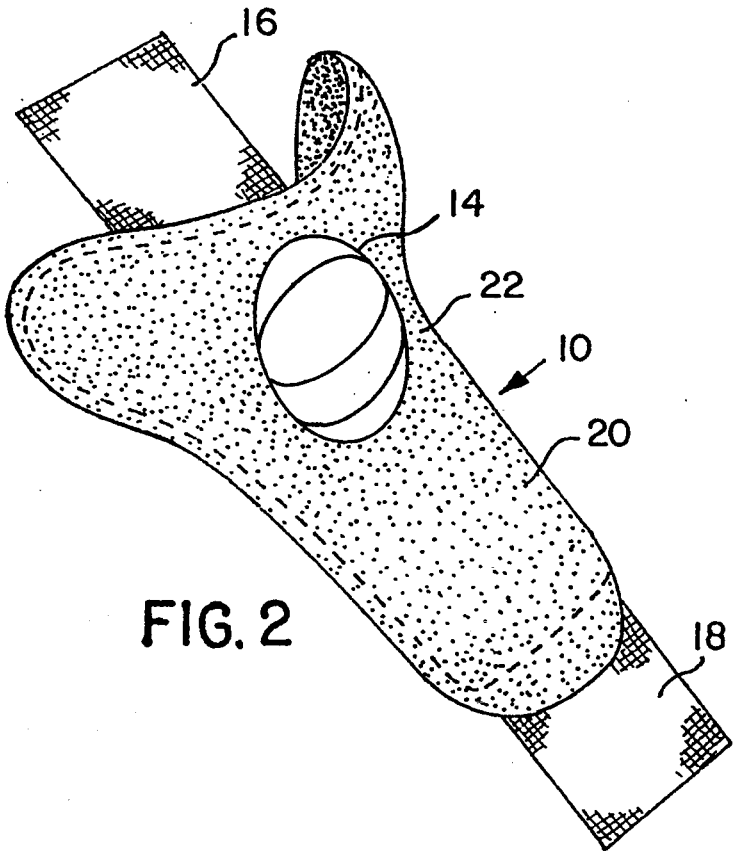
FIG. 2 is a perspective view of the shoestring cover shown in FIG. 1.

Referring now to the drawings and particular to FIGS. 1 and 2, a shoestring cover indicated by the numeral 10 is mounted in operative position on an athletic shoe 12. The cover 10 has a decorative indicia 14 thereon and as shown in FIG. 2 has an upper retaining flap 16 and a lower retaining flap 18 extending from opposite ends of the cover. The cover presents and upwardly facing surface 20 which serves as a wiping surface for wiping dust from the sole of the opposite shoe from which each cover 10 is mounted. The portion of the cover 10 which serves as the wiping surface 20 is made preferably of suede or other suitable material which has an appropriate texture and absorbency to function well as a wiping surface.

Figure 3:
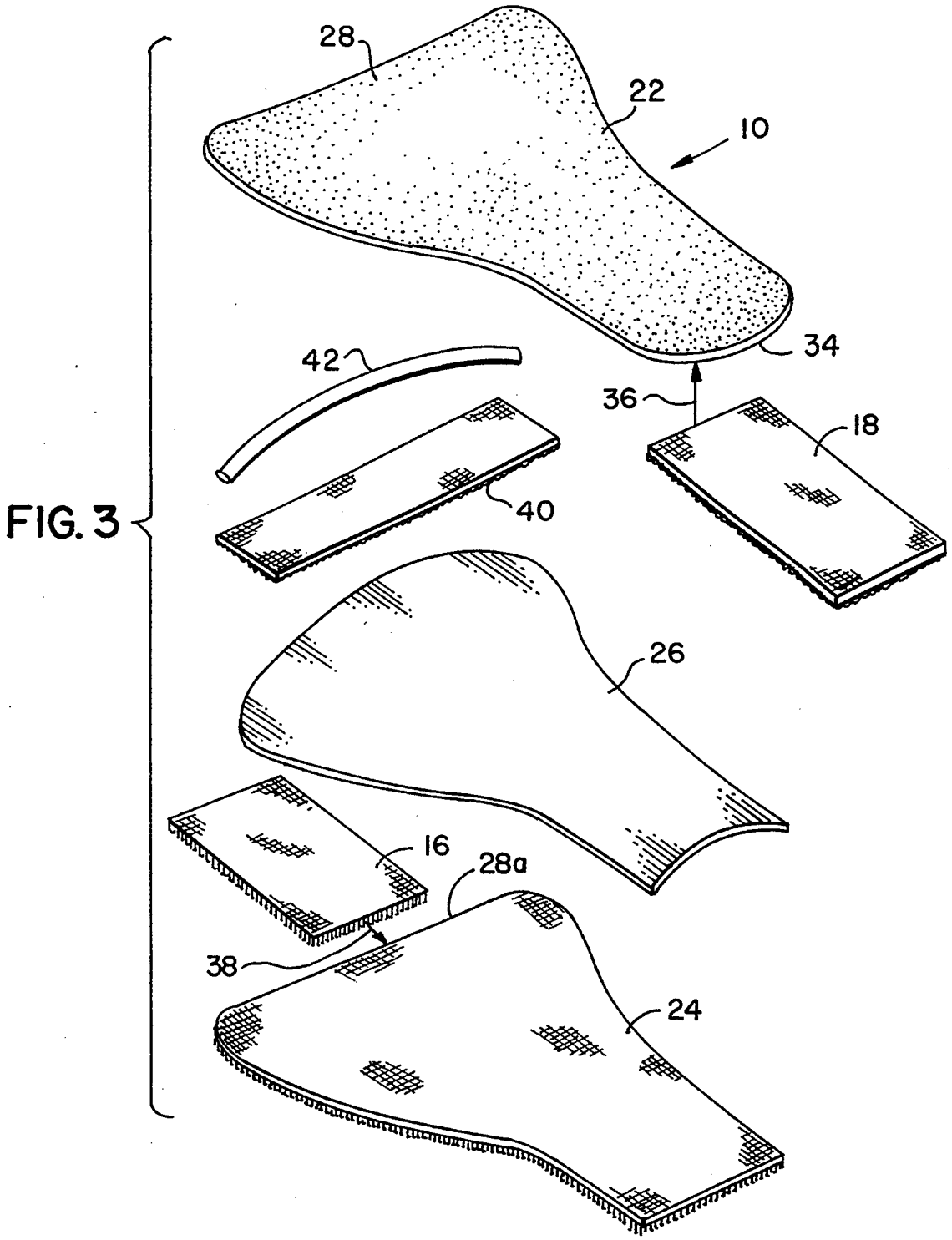
FIG. 3 is an exploded view of the shoestring cover shown in FIG. 2.

As shown in FIG. 3, the cover 10 is a multi-layer construction, having a top sheet 22, a bottom sheet 24 and an intermediate stiffener sheet 26, preferably of plastic material. The sheets 22, 24, and 26 are sewn together around their marginal edges except that the upper edge 28 of the sheet 22 is not sewn to sheets 24 and 26 so that an access opening is provided along the A upper edge 28 to permit access to the pocket 30 shown in FIG. 6 to enable loops and ends of shoestrings 32 to be tucked inside the pocket 30.

As shown in FIG. 3 the flap 18 is sewed to the top sheet 22 near the lower edge 34 near the location indicated by the arrow. 36. The flap 16 is sewed to the top edge **28*a* in the location indicated by the arrow 38. The flap engaging strip 40 is sewed to the bottom surface of the top sheet 22 near the upper edge 28. A stiffener rib 42 is positioned between the strip 40 and the top sheet 22 to aid the stiffener sheet 26 in providing a curved contour of the cover 10** so that it will better conform to the shape of the shoe on which it is mounted.

Figure 4:
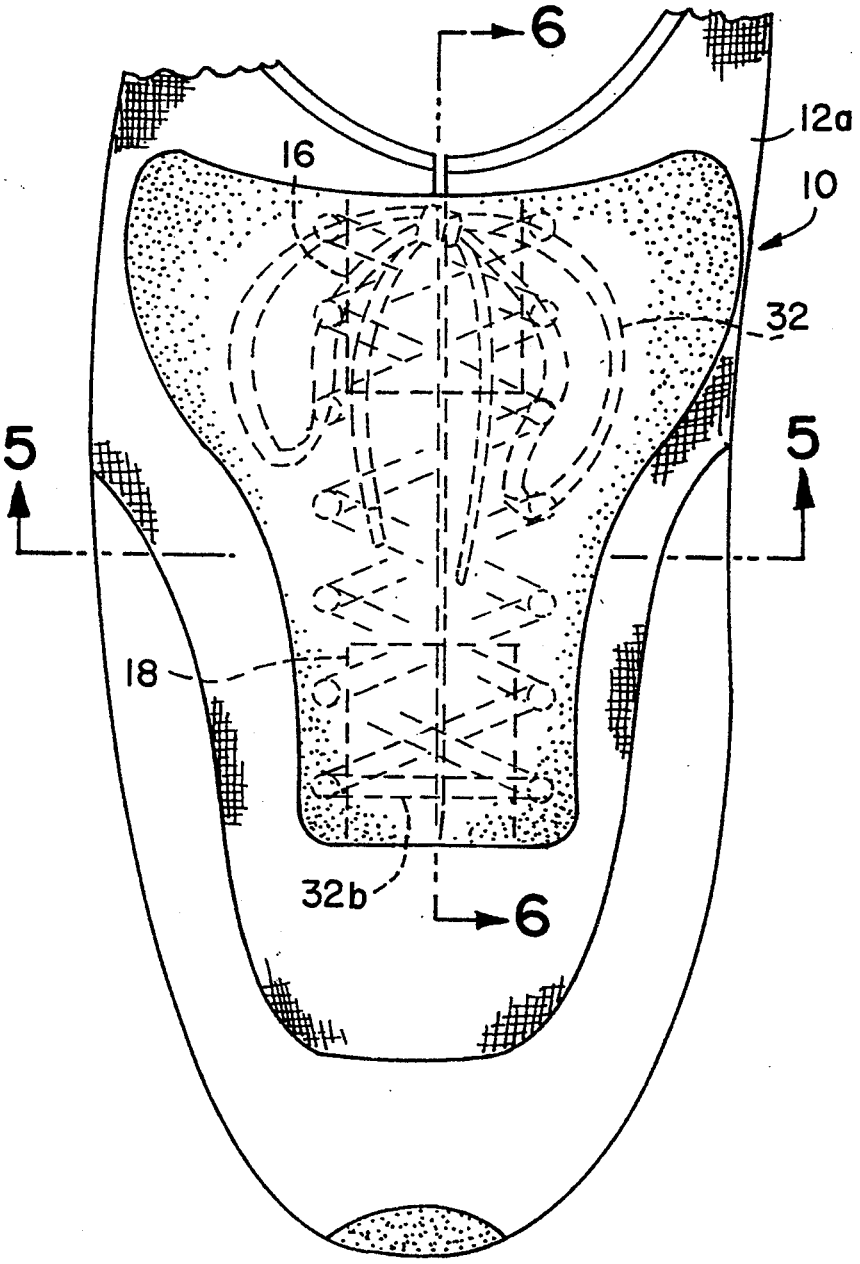
FIG. 4 is a fragmentary top plan view of a shoe having a shoestring cover mounted in operative position thereon.
Figure 5:
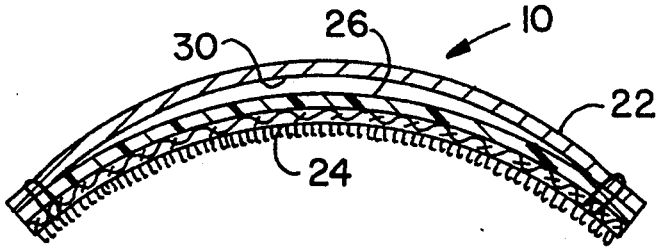
FIG. 5 is a cross-sectional view of the shoestring cover taken on line 5—5 of FIG. 4.
Figure 6:
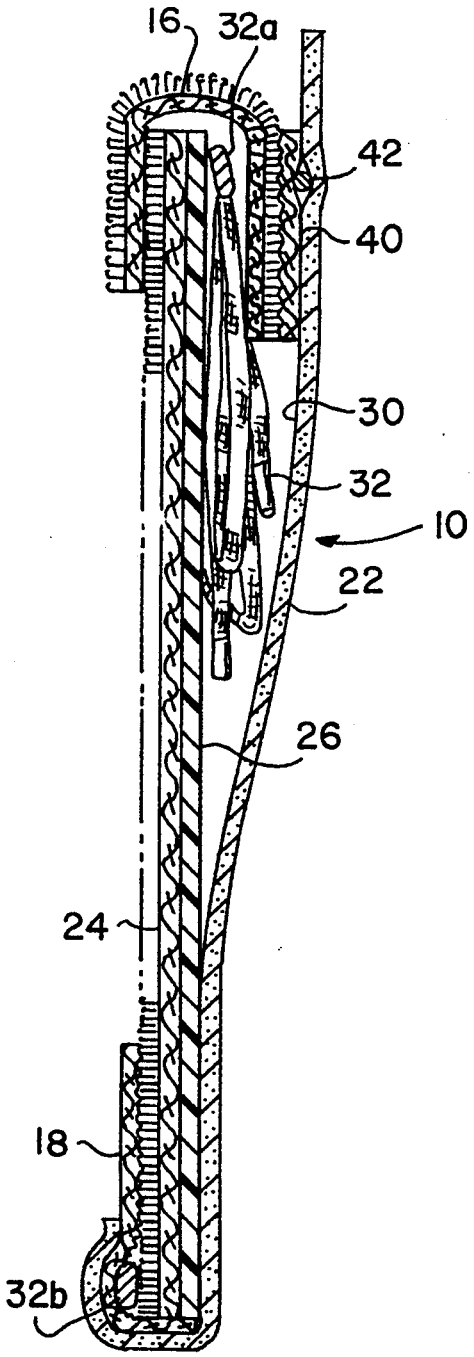
FIG. 6 is a cross-sectional view of the shoestring cover taken on line 6—6 of FIG. 4.

FIG. 6 illustrates the parts of FIG. 3 assembled together with shoestrings 32 tucked inside the pocket 30. FIG. 4 shows the relative position of the cover 10 and the shoestrings 32 with the retaining flaps 16 and 18 folded around portions of the shoestrings 32 to retain the cover 10 in position on the shoe **12*a*. FIG. 5 illustrates the curved contour of the cover 10 which is induced by the stiffener rib 42 and the stiffener sheet 26**.

The means of fastening the flaps 16 and 18 in the retaining position is preferably by the use of "VELCRO" commonly known as a "hook and loop" type fastener. The sheet 24 and the flap 16 have a hook configuration on the bottom surface thereof. The flap 18 and the strip 40 have a loop configuration on the bottom thereof. As shown in FIG. 6, the upper flap 16 passes around a shoestring portion **32*a* and retains the upper edge of the cover 10 on the shoe while holding the shoestrings 32 in the pocket 30. The hooks on the flap 16 engage the loops on the bottom surface of the strip 40. The lower flap 18 folds around a shoestring portion 32*b* and the loops on the flap 18 engage the hooks on the bottom surface of the sheet 24**.

Figure 7:
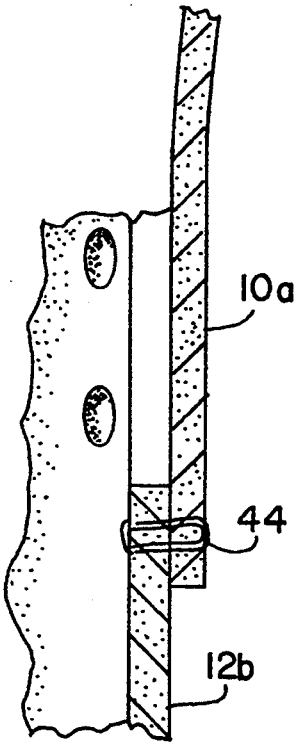
FIG. 7 is a fragmentary cross sectional view of another embodiment of the invention.

FIG. 7 shows an alternative method of attaching the lower edge **34*a* of a cover 10*a* by sewing the cover 10*a* directly to a shoe 12*b* by threads 44. The upper portion of the cover 10*a* can be attached to the shoestrings in the same manner as the cover 10 is attached in FIG. 6**.

In operation the lower flap 18 is first wrapped around the shoestring portion 32*b* and then the upper flap 16 is wrapped around the shoestring portion 32*a* after the shoe has been tied and the shoestring loops and ends tucked into the pocket 30. The flap 16 is then tucked into the pocket 30 so that the hooks on the flap 16 engage the loops on the strip 40.

While the shape of the sheets 22, 24 and 26 are shown as a modified polygon in the shape on an inverted bell it is understood that the shape of these sheets can be varied considerably without departing from the scope of the invention. Whether the side edges are straight or curved or what relative angles the side edges assume are matters of design choice. The primary objective is that the cover covers the shoestrings in the instep area of the shoe and conforms to the shape of the shoe on which it is mounted. While "VELCRO" is shown as a means of fastening the free ends of the retaining flaps, other means may also be used.

It is also understood that the device can be made without one or both of the stiffener members 26 and 42, however, the stiffener members enable the cover to better conform to the contour of the shoe on which it is mounted.

These and other modifications can be made in the cover and its components without departing from the scope of the invention.

I claim:

1. A wiping pad assembly for mounting on the instep portion of shoes having shoestrings, in a position to cover the shoestrings and provide an upwardly facing wiping surface for wiping bottoms of shoes, the assembly comprising:

(A) a substantially polygon shaped-top sheet which serves as a wiping pad;

(B) a bottom sheet of substantially the same shape and size as the top sheet;

(C) both the top and bottom sheet having an upper edge, a lower edge, at least two side edges, a bottom side, and a top side;

(D) the top sheet having an upwardly facing wiping surface on the top side thereof;

(E) the top and bottom sheets being fastened in coextensive alignment along their lower edges and side edges defining a shoestring retaining pocket therebetween having an access opening along their upper edges, said pocket adapted to receive loops and ends of a tied shoe string on a shoe when the wiping pad assembly is attached in operative position on the shoe;

(F) an upper flexible retaining flap having a first end fixedly attached to the upper edge of the bottom sheet for removably engaging a transversely extending upper portion of shoe string adjacent the upper edge of said bottom sheet and said upper flap extending outwardly from the first end to a second end, said second end including means for removably attaching said second end to a surface of said shoe string retaining pocket interior; and (G) a lower flexible retaining flap having a first end fixedly attached to the lower edge of the bottom sheet for removably engaging a transversely extending lower portion of shoe string adjacent said lower edge of said bottom sheet and said lower flap extending outwardly from the first end to a second end, said second end including means for removably attaching said second end to a surface of the wiping pad;

(H) each of said flaps being foldable around a respective adjacent transverse portion of the shoe string and adapted to retain the wiping pad assembly on a shoe when the second ends of each flap has been removably attached to a surface of the wiping pad assembly;

(I) the upper retaining flap having its second end tucked inside the pocket for holding the loops and ends of the tied shoe string in the pocket when the assembly is attached to the shoe.

2. A wiping pad assembly as claimed in claim 1, wherein the second end of each flap is removably attached to a downwardly facing surface of one of the sheets by a hook and loop type fastener.

3. A wiping pad assembly as claimed in claim 1, including a stiffener member attached to at least one of the sheets of the assembly pad to cause the sheets to retain a contour conforming substantially to the contour of the shoe and shoestring in the instep portion of the shoe.

4. A wiping pad assembly as claimed in claim 3, wherein a stiffener member is attached to both of the sheets.

5. A wiping pad assembly as claimed in claim 1, wherein the wiping surface is an absorbent material.

6. A wiping pad assembly as claimed in claim 1, wherein the second end of the flap of the first attachment means attaches to a downwardly facing surface on the top sheet to form a closure for the access opening of the shoe string retaining pocket.

7. A wiping pad assembly for mounting on the instep portion of shoes having shoestrings, in a position to cover the shoestrings and provide an upwardly facing wiping surface for wiping bottoms of shoes, the assembly comprising:

(A) a top sheet and a bottom sheet forming a wiping pad, both sheets having an upper edge, a lower edge, at least two side edges, a bottom side, and a top side, the top side of the top sheet having an upwardly facing wiping surface thereon, the sheets being joined together at the lower and side edges thereof to define a shoestring retaining pocket therebetween, said pocket positioned to receive loops and ends of a tied shoe string of a shoe when the wiping pad assembly is attached in operative position on the shoe;

(B) an upper flexible retaining flap having a first end fixedly attached to the upper edge of the sheets for removably engaging a transversely extending upper portion of shoe string adjacent said upper edge of the sheets and said upper flap extending outwardly from the first end to a second end said second end including means for removably attaching said second end to a surface of said shoe string retaining pocket interior removeably; and (C) a lower flexible retaining flap having a first end fixedly attached to the lower edge of the sheets for removably engaging a transversely extending lower portion of shoe string adjacent said lower edge of the sheets and said lower flap extending outwardly from the first end to a second end, said second end including means for removably attaching said second end to a surface of the wiping pad;

(D) each of said flaps being foldable around a respective adjacent transverse portion of shoe string and adapted to retain the wiping pad assembly on a shoe when the second ends of each flap has been removably attached to a surface of the wiping pad assembly;

(E) the upper retaining flap holding the loops and ends of the tied shoe string in the pocket when the assembly is attached in operative position on the shoe.

8. A wiping pad assembly as claimed in claim 7, wherein the second end of each flap is removably attached to the downwardly facing surface on one of the sheets by a hook and loop type fastener.

9. A wiping pad assembly as claimed in claim 7 including a stiffener member attached to at least one of the sheets to cause the pad to retain a contour conforming substantially to the contour of the shoe and shoestring in the instep portion of the shoe.

10. A wiping pad assembly as claimed in claim 7, wherein the wiping surface is an absorbent material.

* * * * *